US010337825B2

(12) United States Patent
Pikielny

(10) Patent No.: US 10,337,825 B2
(45) **Date of Patent: *Jul. 2, 2019**

(54) FIREARM GRIP WITH ZONES OF DIFFERENT TEXTURES

(71) Applicant: Dov Pikielny, Herzlia (IL)

(72) Inventor: Dov Pikielny, Herzlia (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/881,835

(22) Filed: Jan. 29, 2018

(65) Prior Publication Data

US 2018/0164070 A1 Jun. 14, 2018

Related U.S. Application Data

(63) Continuation of application No. 14/886,279, filed on Oct. 19, 2015, now Pat. No. 9,879,940.

(51) Int. Cl.

| | |
|---|---|
| ***F41C 23/10*** | (2006.01) |
| ***F41A 9/64*** | (2006.01) |
| ***F41C 23/18*** | (2006.01) |

(52) U.S. Cl.
CPC ..... *F41C 23/10* (2013.01); *F41A 9/64* (2013.01); *F41C 23/18* (2013.01)

(58) Field of Classification Search
CPC ..... F41C 23/10; F41C 23/12; F41C 23/14; F41C 23/16; F41C 23/18
USPC ..... 89/1.42; 42/71.01, 71.02, 72, 73, 74; D22/108
See application file for complete search history.

(56) References Cited

U.S. PATENT DOCUMENTS 9,879,940 B2 * 1/2018 Pikielny ..... F41C 23/18

* cited by examiner

*Primary Examiner* — Bret Hayes
(74) *Attorney, Agent, or Firm* — Dekel Patent Ltd.; David Klein

(57) ABSTRACT

A grip for a weapon has a front strap, side panels and a back strap, and the grip includes zones having different textures.

19 Claims, 3 Drawing Sheets

FIREARM GRIP WITH ZONES OF DIFFERENT TEXTURES

CROSS-REFERENCE TO RELATED APPLICATIONS

This application is a continuation of, and claims priority from, U.S. patent application Ser. No. 14/886,279, filed 19 Oct. 2015, now U.S. Pat. No. 9,879,940, which is incorporated herein by reference.

FIELD OF THE INVENTION

The present invention relates generally to firearms and firearm grips, and particularly to a grip with zones of different textures.

BACKGROUND OF THE INVENTION

As is well known in the art, firearms and handguns come in a variety of manufactured sizes, e.g., some referred to as full-size, compact and sub-compact. Hand grips for such weapons are often ergonomically formed of materials which are easy to grip, some of which are even compressible, to allow the user to better grasp the firearm handle. The grips often include a front strap, side panels and a back strap.

SUMMARY OF THE INVENTION

The present invention seeks to provide a novel grip with zones of different textures, as is described more in detail hereinbelow.

There is provided in accordance with a non-limiting embodiment of the present invention a weapon including a trigger, receiver, slide and grip, the grip having a front strap, side panels and a back strap, wherein the grip includes zones having different textures.

The textures may differ from each other in roughness and level of friction; the texture prevents slipping with respect to a shooter's hand.

The zones may be located according to the different skin roughness, gripping strength and sensitivity provided by the different fingers of a shooter's hand.

In accordance with an embodiment of the present invention, the zones include a first zone, which has a first anti-slip surface texture, a second zone, which has a second anti-slip surface texture rougher than the first anti-slip surface texture, and a third zone, which has a third surface texture that is less rougher than the textures of the first and second zones.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
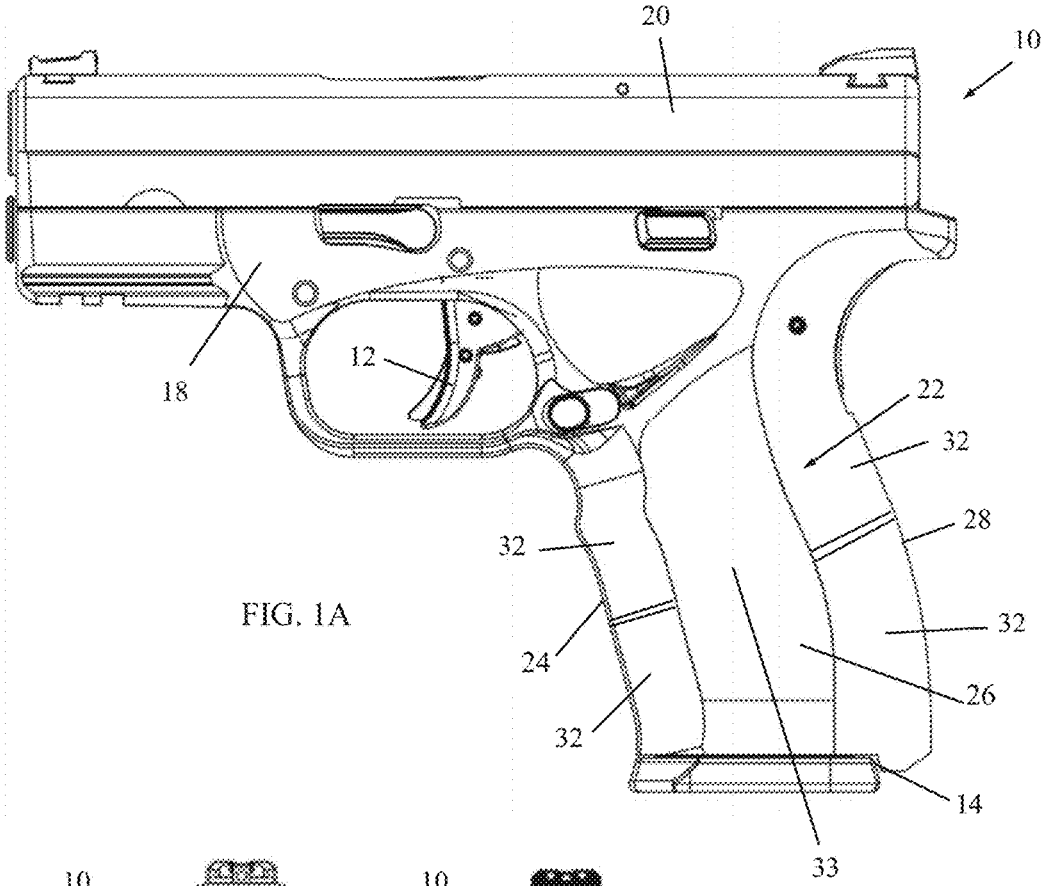
FIGS. 1A, 1B and 1C are simplified side-view, front-view and rear-view illustrations, respectively, of a weapon with different grip zones, constructed and operative in accordance with a non-limiting embodiment of the present invention.
Figure 1B:
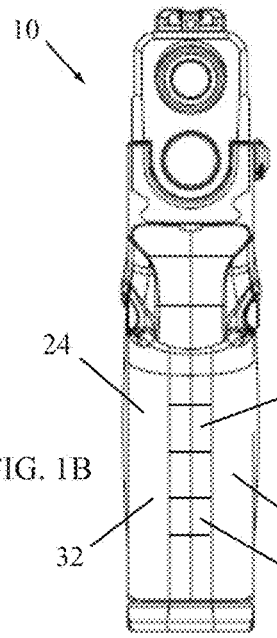
Figure 1C:
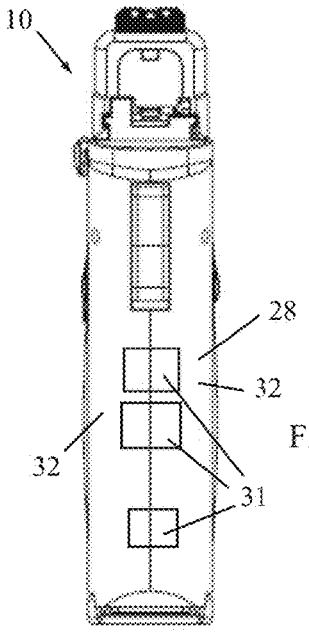

Reference is now made to FIGS. 1A-1C, which illustrate a weapon 10 with different grip zones, constructed and operative in accordance with a non-limiting embodiment of the present invention. The invention is applicable for many kinds of weapons, such as but not limited to, handguns, revolvers, rifles and many more.

Weapon 10, as in typical weapons, includes a trigger 12, magazine well 14 (but the invention is applicable for weapons that do not use magazines), receiver 18, slide 20 and grip 22. Grip 22 has a front strap 24, side panels 26 and a back strap 28.

In accordance with a non-limiting embodiment of the present invention, the grip 22 has zones of different textures. The textures differ from each other in roughness and level of friction the texture provides against slipping with respect to the shooter's hand. The textures may be created by any suitable technique, such as but not limited to, stippling, knurling, checkering and others. The geometric shapes of the different textures may include, without limitation, squares, triangles, hexagons, circles, ellipses, irregular shapes, etc.

The different grip zones may be located according to various ergonomic factors, such as but not limited to, skin roughness and gripping strength provided by the fingers of the hand.

Figure 2A:
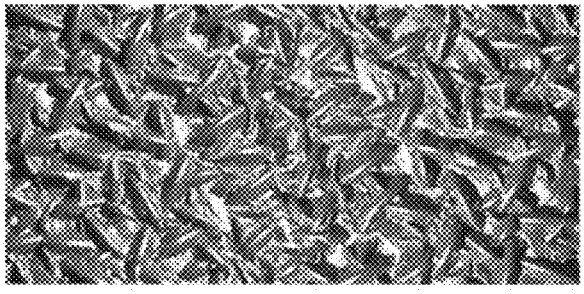
FIGS. 2A, 2B and 2C are simplified pictorial illustrations of three different textures of grip zones used in the weapon of FIGS. 1A-1C, in accordance with a non-limiting embodiment of the present invention.
Figure 3:
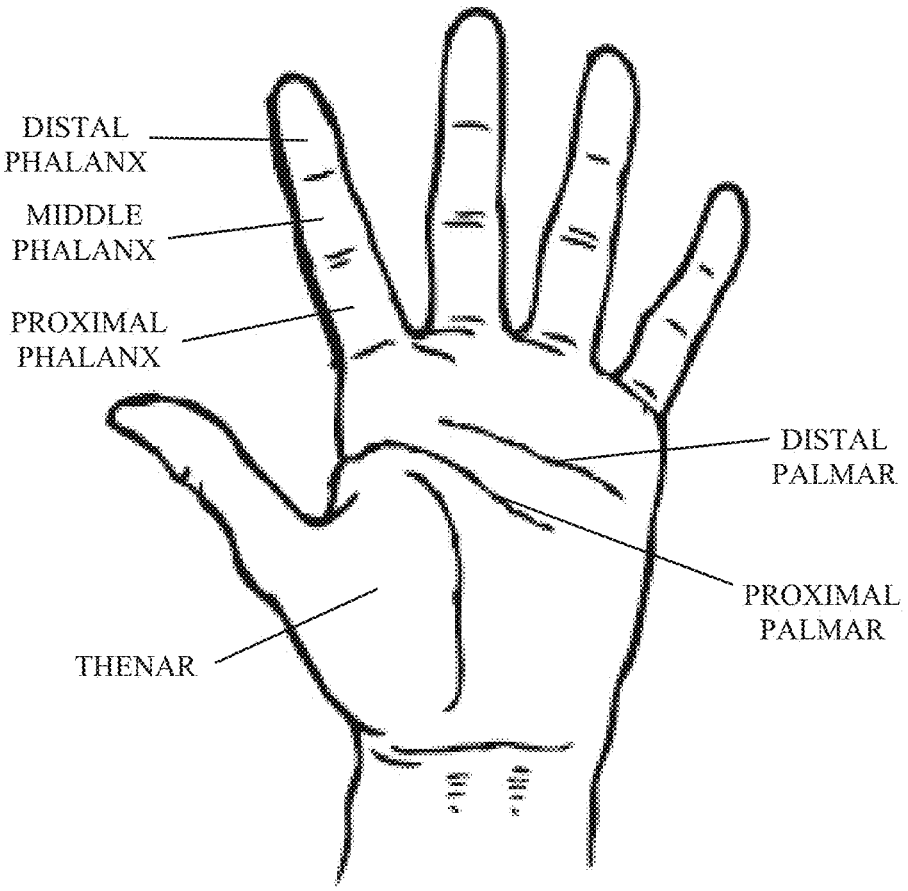
FIG. 3 PRIOR ART
FIG. 3 is a diagram of the human hand.

A first zone 31 has a first anti-slip surface texture shown in FIG. 2A, which enables positive hand to weapon engagement with corresponding sensitive parts of the hand. In one embodiment, the first zone 31 contacts the middle phalanxes of the index, middle and ring fingers and portions of the palm between the thenar and proximal palmar of the shooter's hand. (Refer to FIG. 3 for a diagram of the human hand.) The first zone 31 may be formed on the front strap 24 and back strap 28.

Figure 2B:
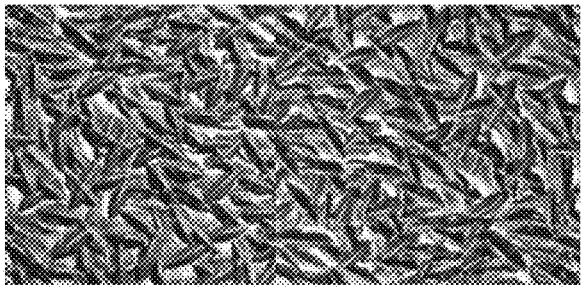

A second zone 32 has a second anti-slip surface texture shown in FIG. 2B, which is rougher than the first anti-slip surface texture. In one embodiment, the second zone 32 contacts the distal and proximal phalanxes of the index, middle and ring fingers and the proximal phalanx of the thumb and near the junction of the thumb and palm of the shooter's hand. The second zone 32 is more aggressively textured than the first zone 31, yet still comfortable to the touch. The second zone 32 is intended to make contact with the shooter's hand where maximum friction is needed. The second zone 32 works in combination with the first zone 31 to keep the weapon in place and under control during recoil. The second zone 32 may be formed on the front strap 24 and back strap 28, and optionally on parts of the side panels 26.

Figure 2C:
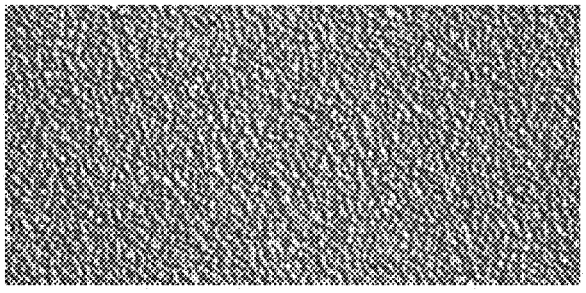

A third zone 33 has a third surface texture shown in FIG. 2C, which is less rougher than the textures of first and second zones 31 and 32. In one embodiment, the third zone 33 contacts the middle phalanx of the small finger and portions of the palm between or near the distal and proximal palmars of the shooter's hand.

The third zone 33 may cover all other areas of the grip 22, and may also cover other areas of the receiver.

The three grip zones provide improved grasp performance and stickier grip characteristics resulting in the shooter's hand being less prone to torque, wrench and flip from the weapon when shooting. The weapon naturally tends to stay in position due to the increased traction of the textures.

The grip 22 may be constructed of any suitable material, such as but not limited to, polymer, composite material, metal, wood, and others.

In an alternative embodiment of the invention, the positions of the first and second zones may be switched, so that the rougher areas are where the first zone was described above.

What is claimed is:

1. A weapon comprising:

a trigger, receiver, slide and grip, said grip having a front strap, side panels and a back strap, wherein said grip comprises zones having different textures, wherein said zones comprise a first zone, which has a first anti-slip surface texture, a second zone, which has a second anti-slip surface texture rougher than the first anti-slip surface texture, and a third zone, which has a third surface texture that is less rough than the textures of said first and second zones, and wherein said first zone comprises a plurality of more than two discrete zones on said back strap and wherein said second zone extends to areas on said back strap that are between said discrete zones.

2. The weapon according to claim 1, wherein said textures differ from each other in roughness and level of friction the texture provides against slipping with respect to a shooter's hand.

3. The weapon according to claim 1, wherein said zones are located according to skin roughness and gripping strength provided by fingers of a shooter's hand.

4. The weapon according to claim 1, wherein said discrete zones do not extend to said side panels.

5. The weapon according to claim 1, wherein said first zone is arranged to contact middle phalanxes of index, middle and ring fingers, and portions of a palm between a thenar and proximal palmar of a shooter's hand.

6. The weapon according to claim 1, wherein said second zone is arranged to contact distal and proximal phalanxes of index, middle and ring fingers, a proximal phalanx of a thumb, and near a junction of the thumb and palm of a shooter's hand.

7. The weapon according to claim 1, wherein said third zone is arranged to contact a middle phalanx of a small finger, and portions of a palm between or near distal and proximal palmars of a shooter's hand.

8. The weapon according to claim 1, wherein said discrete zones of said first zone are symmetrically positioned with respect to a vertical centerline on said back strap.

9. The weapon according to claim 1, wherein said discrete zones of said first zone are formed one above another on said back strap.

10. The weapon according to claim 1, wherein said third zone covers areas of said grip not covered by said first and second zones.

11. The weapon according to claim 1, wherein said third zone covers other areas of said receiver.

12. An article comprising:

a grip for a weapon, said grip having a front strap, side panels and a back strap, wherein said grip comprises zones having different textures, wherein said zones comprise a first zone, which has a first anti-slip surface texture, a second zone, which has a second anti-slip surface texture rougher than the first anti-slip surface texture, and a third zone, which has a third surface texture that is less rough than the textures of said first and second zones, and wherein said first zone comprises a plurality of more than two discrete zones on said back strap and wherein said second zone extends to areas on said back strap that are between said discrete zones.

13. The article according to claim 12, wherein said textures differ from each other in roughness and level of friction the texture provides against slipping with respect to a shooter's hand.

14. The article according to claim 12, wherein said zones are located according to skin roughness and gripping strength provided by fingers of a shooter's hand.

15. The article according to claim 12, wherein said discrete zones do not extend to said side panels.

16. The article according to claim 12, wherein said discrete zones of said first zone are symmetrically positioned with respect to a vertical centerline on said back strap.

17. The article according to claim 12, wherein said discrete zones of said first zone are formed one above another on said back strap.

18. The article according to claim 12, wherein said third zone covers areas of said grip not covered by said first and second zones.

19. The article according to claim 12, wherein said third zone covers other areas of said receiver.

* * * * *